US011648699B2

(12) United States Patent
Brette

(10) Patent No.: US 11,648,699 B2
(45) Date of Patent: May 16, 2023

(54) SMART SHAVING SYSTEM WITH A 3D CAMERA

(71) Applicant: BIC VIOLEX S.A., Anoixi (GR)

(72) Inventor: Thomas Brette, Saint Germain en Laye (FR)

(73) Assignee: BIC Violex Single Member S.A., Anoixi (GR)

( * ) Notice: Subject to any disclaimer, the term of this patent is extended or adjusted under 35 U.S.C. 154(b) by 20 days.

(21) Appl. No.: 17/054,586

(22) PCT Filed: May 13, 2019

(86) PCT No.: PCT/EP2019/062225
§ 371 (c)(1),
(2) Date: Nov. 11, 2020

(87) PCT Pub. No.: WO2019/224037
PCT Pub. Date: Nov. 28, 2019

(65) Prior Publication Data

US 2021/0086379 A1 Mar. 25, 2021

Related U.S. Application Data

(60) Provisional application No. 62/674,099, filed on May 21, 2018.

(51) Int. Cl.
*B26B 21/40* (2006.01)
*B26B 19/38* (2006.01)

(52) U.S. Cl.
CPC ..... *B26B 21/4056* (2013.01); *B26B 19/388* (2013.01); *B26B 21/4081* (2013.01)

(58) Field of Classification Search
CPC . B26B 21/4056; B26B 21/4081; B26B 21/40; B26B 19/38; B26B 19/388
(Continued)

(56) References Cited

U.S. PATENT DOCUMENTS 8,928,747 B2 1/2015 Burdoucci
9,848,174 B2 12/2017 Binder
(Continued)

FOREIGN PATENT DOCUMENTS

CN 105744854 A 7/2016
CN 107756459 A 3/2018
(Continued)

OTHER PUBLICATIONS

International Search Report and Written Opinion issued in International Application No. PCT/EP2019/062225, dated Jul. 5, 2019 (13 pages).
(Continued)

*Primary Examiner* — Nhat Chieu Q Do
(74) *Attorney, Agent, or Firm* — Bookoff McAndrews, PLLC

(57) ABSTRACT

A smart shaving system with a three-dimension (3D) camera assists the user of a shaving razor. The 3D camera is communicatively connected to the shaving razor and to a razor cartridge vendor platform via an Internet-of-Things (IoT) gateway. The 3D camera can be incorporated into the shaving razor. The razor has hardware/software capabilities to function as a stand-alone Internet-of-Things (IoT) device. The 3D camera can assist the user to determine whether a particular skin surface area has been adequately shaved, and/or (ii) assist the user regarding the type of shaving cartridge and/or razor suited for the particular user's physical characteristics (e.g., skin and/or hair).

17 Claims, 12 Drawing Sheets

(58) Field of Classification Search
USPC ..... 30/194
See application file for complete search history.

(56) References Cited

U.S. PATENT DOCUMENTS

| | | | | |
|---|---|---|---|---|
| 2010/0186234 | A1 | 7/2010 | Binder | |
| 2013/0021460 | A1 | 1/2013 | Burdoucci | |
| 2014/0137883 | A1* | 5/2014 | Rothschild | B26B 19/388 132/200 |
| 2015/0103158 | A1 | 4/2015 | Burris et al. | |
| 2016/0167241 | A1 | 6/2016 | Goldfarb et al. | |
| 2016/0262521 | A1* | 9/2016 | Kustra | G06T 7/38 |
| 2017/0232624 | A1 | 8/2017 | King | |
| 2018/0354147 | A1* | 12/2018 | Goldfarb | B26B 21/4087 |

FOREIGN PATENT DOCUMENTS

| | | | |
|---|---|---|---|
| EP | 3366195 | A1 * | 8/2018 |
| WO | 2015067484 | A1 | 5/2015 |
| WO | 2015067634 | A1 | 5/2015 |
| WO | 2015140340 | A1 | 9/2015 |
| WO | 2017012969 | A1 | 1/2017 |
| WO | 2018007547 | A1 | 1/2018 |
| WO | 2018033831 | A1 | 2/2018 |

OTHER PUBLICATIONS

Chinese Office Action in corresponding Chinese Application No. 201980027732.0, dated Feb. 23, 2022 (8 pages).

* cited by examiner

SMART SHAVING SYSTEM WITH A 3D CAMERA

CROSS REFERENCE TO RELATED APPLICATIONS

This application is a National Stage Application of International Application No. PCT/EP2019/062225, filed on May 13, 2019, now published as WO/2019/224037 and which claims priority to U.S. Provisional Patent Application Ser. No. 62/674,099, entitled "A SMART SHAVING SYSTEM WITH A 3D CAMERA," filed on May 21, 2018.

BACKGROUND OF THE DISCLOSURE

1. Field of the Disclosure

The present disclosure relates to smart shaving system with a shaving razor having a razor handle and a replaceable cartridge with one or more blades. More particularly, the present disclosure relates to a smart shaving system with a 3D camera to assist the user of the shaving razor.

2. Description of the Related Art

To achieve optimal shaving results, it is helpful to tailor the choice of a shaving razor to the unique physical characteristics of a user, e.g., skin contour, skin type, skin characteristics, moles, scars, in-grown hair, growths, hair type, and hair thickness. In addition, it is often difficult for a user to determine (e.g., by visual inspection or using a 2D (2-dimensional) camera) the user's unique physical characteristics such as the ones noted above, as well as to determine whether a particular skin surface area has been adequately shaved. Therefore, there is a need for a system that will (i) assist in determining the unique physical characteristics of a user, which determination will in turn assist in tailoring the choice of a shaving razor to the unique physical characteristics of the user, and (ii) assist in determining whether a particular skin surface area has been adequately shaved.

SUMMARY

The present disclosure provides a smart shaving system with a 3D (3-dimensional) camera to assist the user of a shaving razor.

The present disclosure also provides a smart shaving system with a 3D camera to assist the user of a shaving razor, which 3D camera is incorporated into the razor.

The present disclosure also provides a smart shaving system with a 3D camera to assist the user of a shaving razor, which 3D camera is incorporated into the razor to assist the user of the razor to determine whether a particular skin surface area has been adequately shaved.

The present disclosure also provides a smart shaving system with a 3D camera incorporated into a shaving razor, which razor has hardware/software capabilities to function as a stand-alone Internet-of-Things (IoT) device.

The present disclosure further provides a smart shaving system with a 3D camera to assist the user of a shaving razor, which 3D camera is incorporated into the razor to enable the user to perform a 3D scan of a body area to be shaved (e.g. face, legs, etc.) in order to (i) determine whether the skin surface of the particular body area has been adequately shaved and/or (ii) guide the user while shaving (by having performed and stored a 3D scan prior to shaving).

The present disclosure further provides a smart shaving system with a 3D camera to assist the user of a shaving razor, which 3D camera is communicatively connected to the shaving razor.

The present disclosure further provides a smart shaving system with a 3D camera to assist the user of a shaving razor, which 3D camera is communicatively connected to the shaving razor to assist the user of the razor to determine whether a particular skin surface area has been adequately shaved.

The present disclosure further provides a smart shaving system with a 3D camera to assist the user of a shaving razor, which 3D camera is communicatively connected to a razor cartridge vendor platform via an Internet-of-Things (IoT) gateway.

The present disclosure further provides a smart shaving system with a 3D camera to assist the user of a shaving razor, which 3D camera is communicatively connected to the shaving razor to enable the user to perform a 3D scan of a body area to be shaved (e.g. face, legs, etc.) in order to (i) determine whether the skin surface of the particular body area has been adequately shaved and/or (ii) guide the user while shaving (by having performed and stored a 3D scan prior to shaving).

The present disclosure further provides a smart shaving system with a 3D camera to assist the user of a shaving razor, which 3D camera is communicatively connected to the shaving razor and/or to a razor cartridge vendor platform via an Internet-of-Things (IoT) gateway to (i) assist the user to determine whether a particular skin surface area has been adequately shaved, and/or (ii) assist the user regarding the type of shaving cartridge and/or razor suited for the particular user's physical characteristics (e.g., skin and/or hair).

The present disclosure further provides a smart shaving system in which a 3D camera, a razor, a razor cartridge vendor platform and/or other linked devices can access and/or cumulatively collect, store, and/or analyze a particular user's physical characteristics (e.g., hair and skin type), historical shaving cartridge information, and/or shaving habits to assist the particular user regarding the type of shaving cartridge and/or razor suited for the particular user's physical characteristics (e.g., skin and/or hair), historical shaving cartridge information and shaving habits.

FIG. **6*a*** is a schematic showing various electric/electronic components of a razor and an external communication infrastructure, as well as communication paths between the razor and the external communication infrastructure, according to an embodiment of the present disclosure.

FIG. **6*b*** is a schematic showing various electric/electronic components of a razor, as well as communication paths among the razor, external devices, and an external communication infrastructure, according to another embodiment of the present disclosure.

Figure 7:
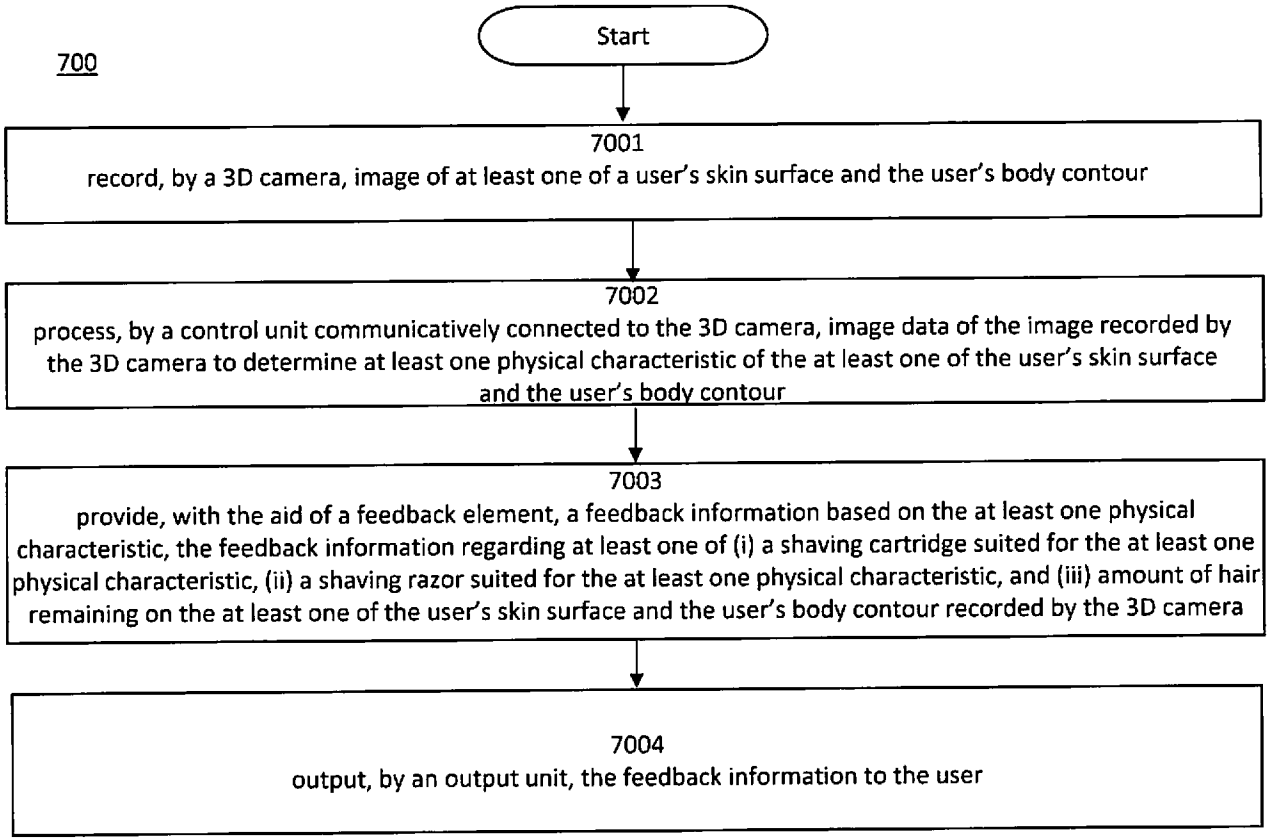

FIG. 7 is a logic flow chart of a method according to an example embodiment.

Figure 8:
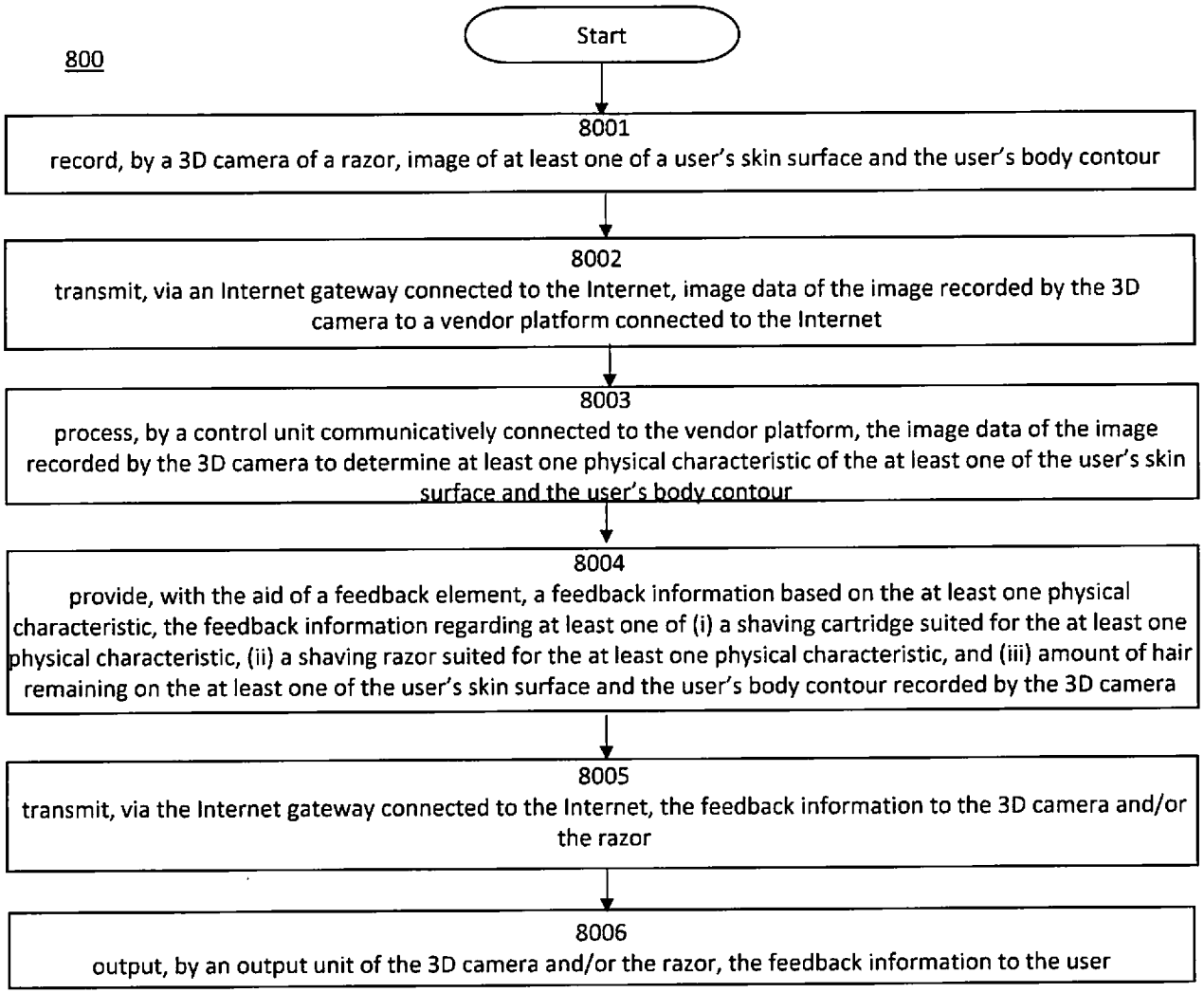

FIG. 8 is a logic flow chart of a method according to another exemplary embodiment.

Figure 9:
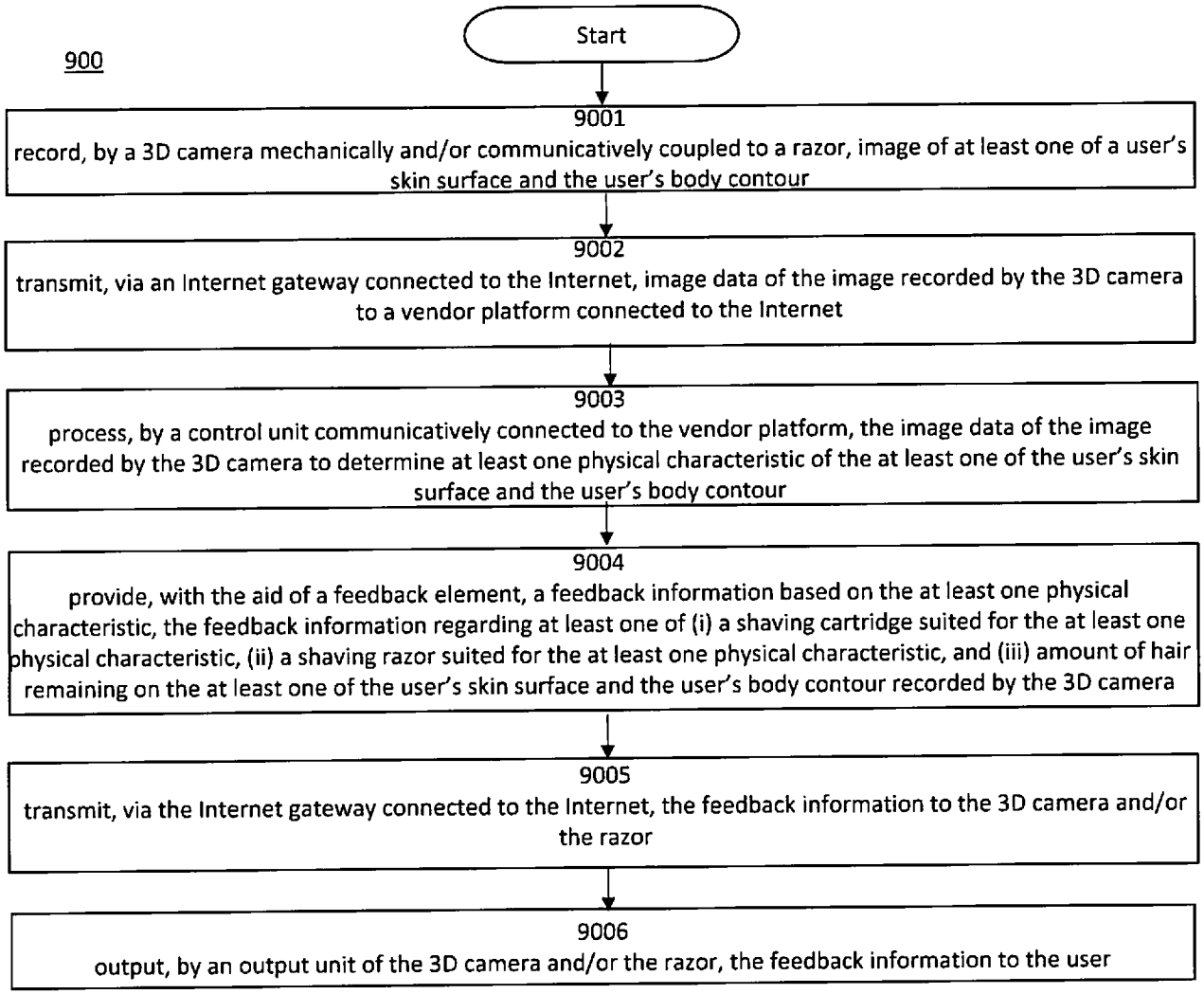

FIG. 9 is a logic flow chart of a method according to yet another exemplary embodiment.

Figure 10:
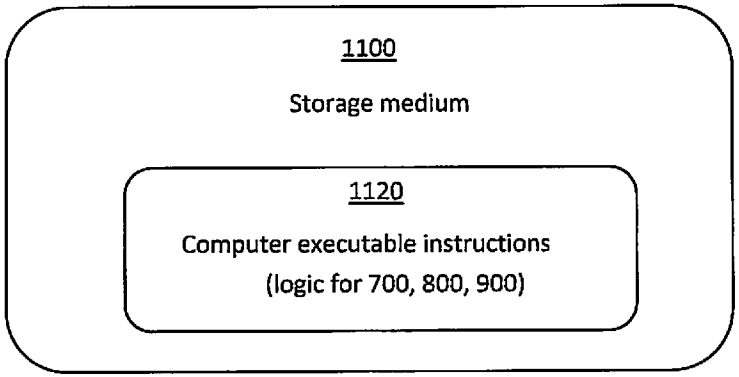

FIG. 10 is a computer-readable storage medium according to an embodiment herein.

Figure 11:
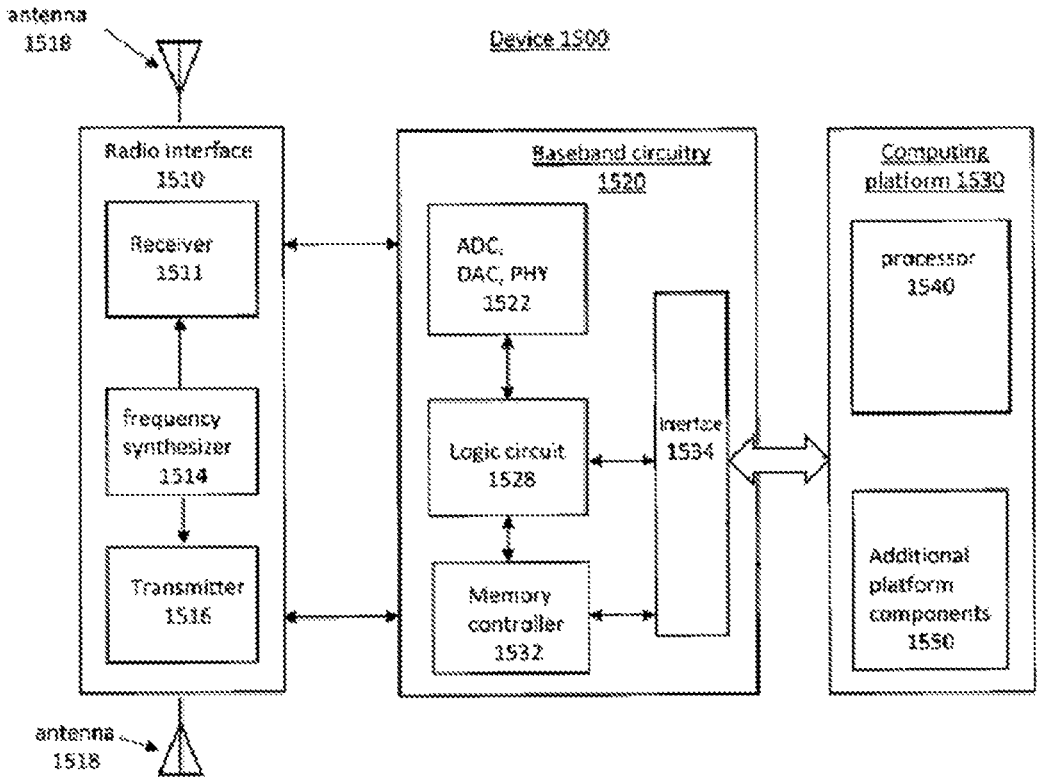

FIG. 11 is an embodiment of a communication device for implementing one or more logic flows herein.

Figure 12:
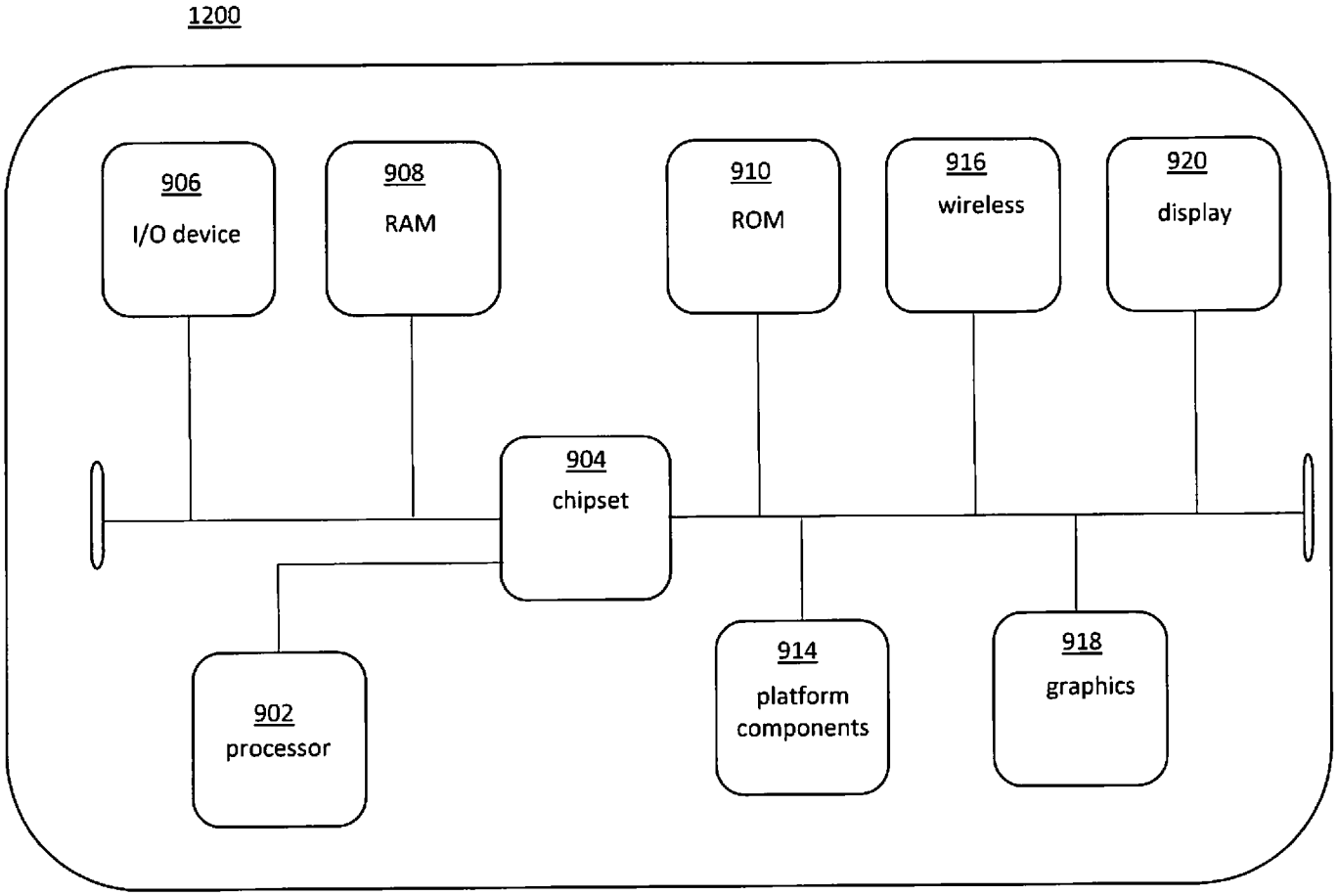

FIG. 12 is an embodiment of a system of the present disclosure.

A component or a feature that is common to more than one drawing is indicated with the same reference number in each of the drawings.

DETAILED DESCRIPTION OF THE DISCLOSURE

Figure 1:
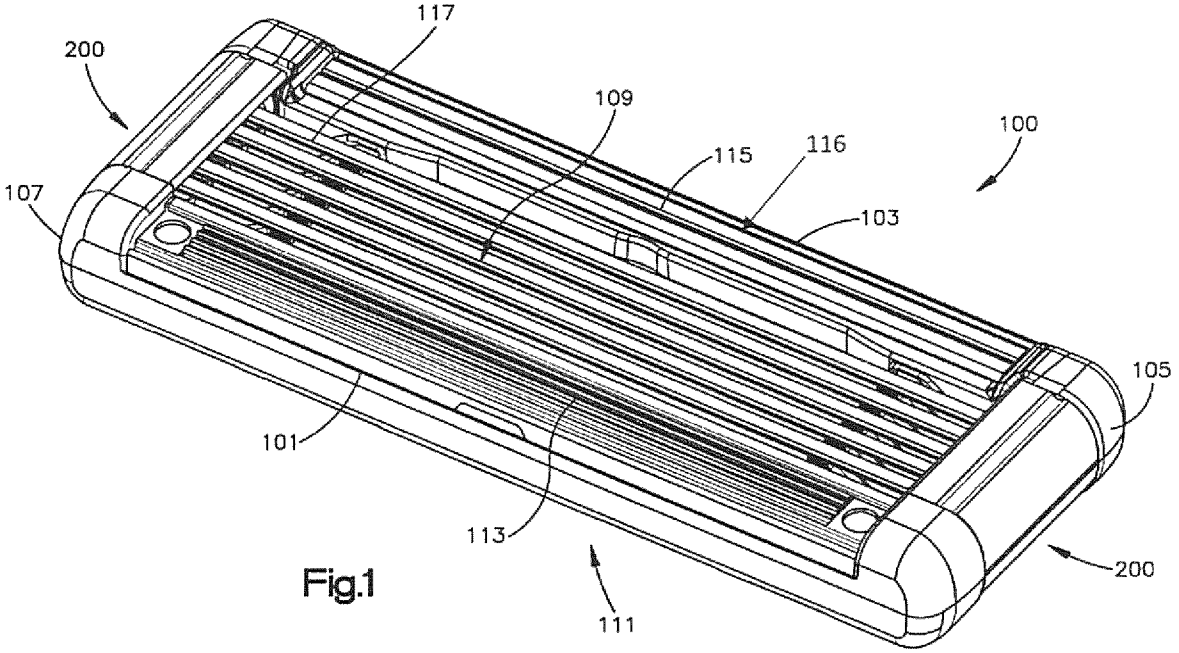
FIG. 1 is a perspective view of an example of a shaving cartridge.

Referring to the drawings and, in particular to FIG. 1, a shaving cartridge is shown and generally represented by reference numeral 100. Shaving cartridge 100 includes retainers 200 for securing blades 117 to shaving cartridge 100. Shaving cartridge 100 also has a housing having a front edge 101, a rear edge 103, a pair of side edges 105, 107, a top surface 109, and a bottom surface 111. The pair of side edges 105, 107 extend between front edge 101 of the housing and rear edge 103 of the housing. Shaving cartridge 100 includes a guard bar 113 adjacent to front edge 101 of the housing and a cap 115 adjacent to rear edge 103 of the housing. A lubricating strip 116 can be provided on the surface of the cap 115. One or more blades 117 are positioned between the guard bar 113 and cap 115, and retained in position in the housing using one or more retaining element(s), e.g., a pair of retainers 200 positioned in the housing. Although shaving cartridge 100 shown in FIG. 1 includes five blades 117 retained in position in the housing using a pair of retainers 200, any number of blades can be used and any number and/or type of retaining element(s), e.g., one or more retaining clips, can be provided at suitable location(s) to retain the blade(s) in position. In addition, although the lubricating strip 116 is shown in the example as being provided on the cap 115, the lubricating strip can be provided on any other area of the cartridge, e.g., on the guard bar 113 and/or on the retainer(s) 200.

Figure 2:
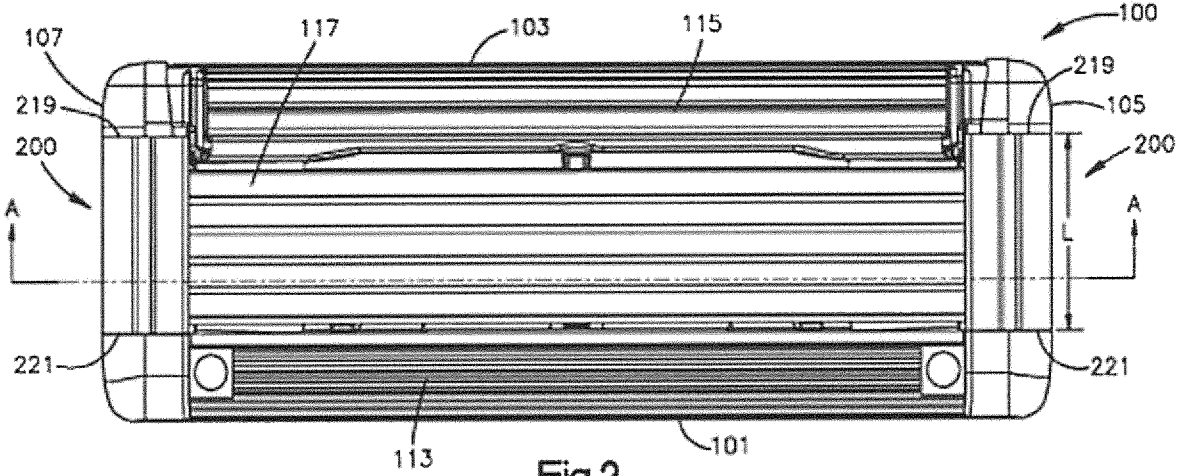
FIG. 2 is a top view of the shaving cartridge.
Figure 3:
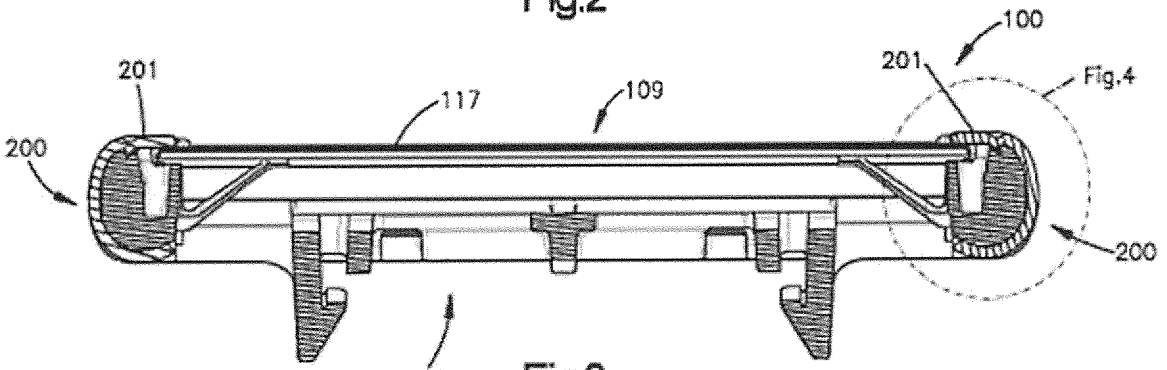
FIG. 3 is a cross-sectional view of the shaving cartridge along the line A-A in FIG. 2.

Referring to FIGS. 2-3, retainers 200 are spaced apart and positioned on opposite sides of the housing. Retainers 200 extend along side edges 105 and 107 of the housing and include a top portion 201 that extends above top surface 109 of the housing and above one or more blades 117 to retain the position of blades 117 in the housing. Retainers 200 can be made of metal. Retainers 200 physically contact blades 117, so that retainers 200 and one or more of the blades can form an electrical path.

In this embodiment, retainers 200 extend along a length L on side edges 105 and 107 of about 8.5 mm, for example. However, it should be appreciated that retainers 200 can extend along a shorter or longer portion of side edges 105 and 107. For example, a pair of retainers 200 can each extend along the entire length, a shorter portion, or a longer portion of side edges 105 and 107. Such extensions can secure in place a guard bar, a cap element, or a trimmer assembly, for example. In addition, as noted above, any number of retainers 200 can be used with shaving cartridge 100. For example, a single retainer 200 or four retainers 200 can be used to retain the position of blades 117 in the housing.

Figure 4:
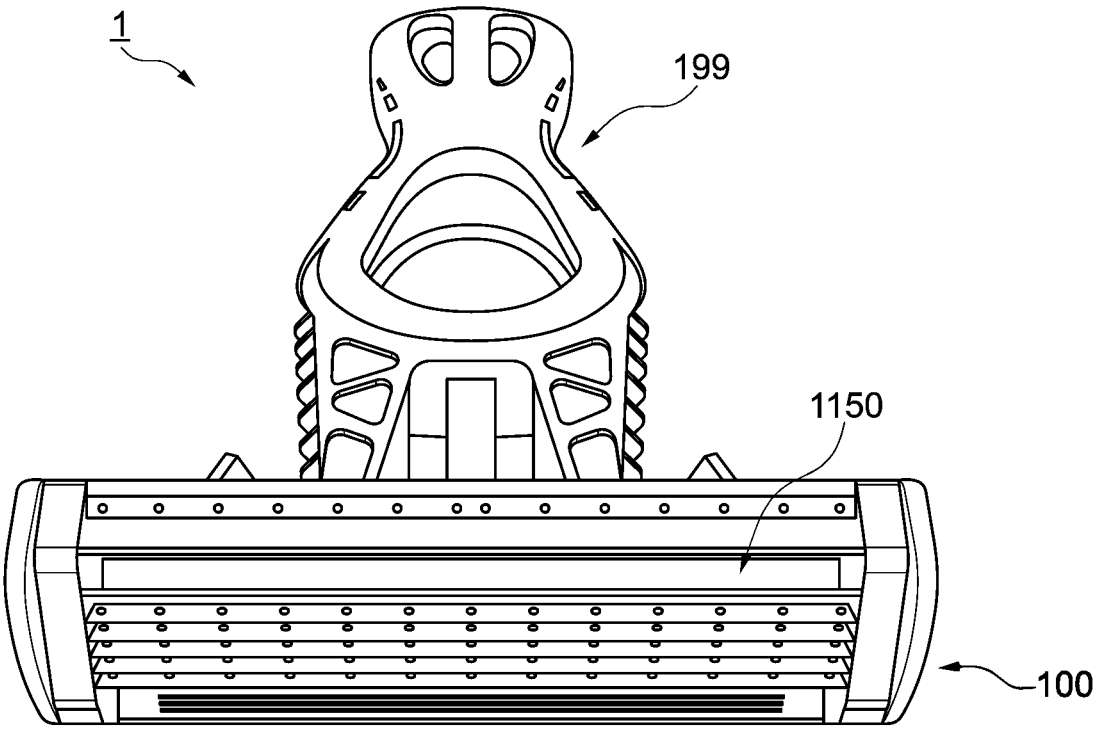
FIG. 4 is a perspective view of a razor having a handle and a shaving cartridge.
Figure 5:
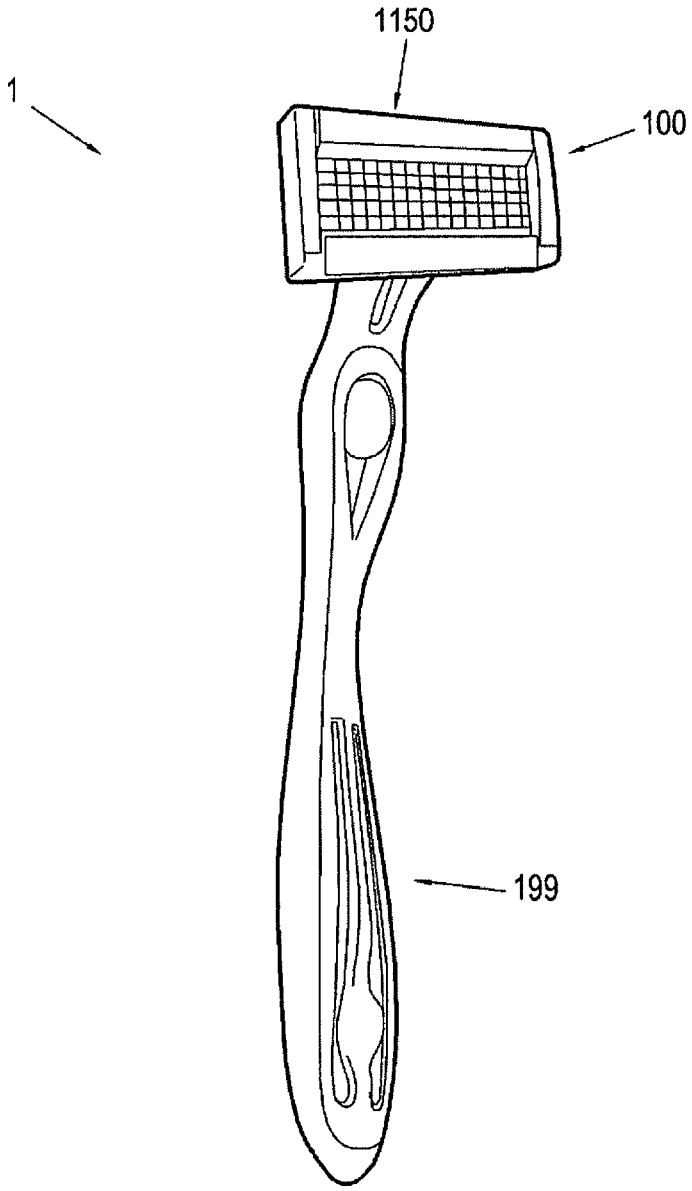
FIG. 5 is another perspective view of a razor having a handle and a shaving cartridge.

FIGS. 4-5 show an example razor 1 having a handle 199 and a cartridge 100. In this exemplary embodiment, a "smart" polymer 1150 designed to selectively generate lubricant, cosmetic and/or other materials can be provided on the cartridge. "Smart" polymers are artificial materials designed to respond in a particular manner when exposed to at least one environmental stimulus. The environmental stimulus can include temperature, pH, humidity/moisture, redox, weight, electrical stimulus, chemical stimulus, light (wavelength and/or intensity), electric/magnetic field, and/or electrochemical stimulus. The location of the smart polymer 1150 substantially corresponds to the surface of the cap 115 shown in FIGS. 1-2. In addition, various components (including electric and/or electronic components) and circuitry can be provided in or on the razor to implement various aspects of the present disclosure, as shown in FIGS. 6*a* and 6*b*.

Figure 6A:
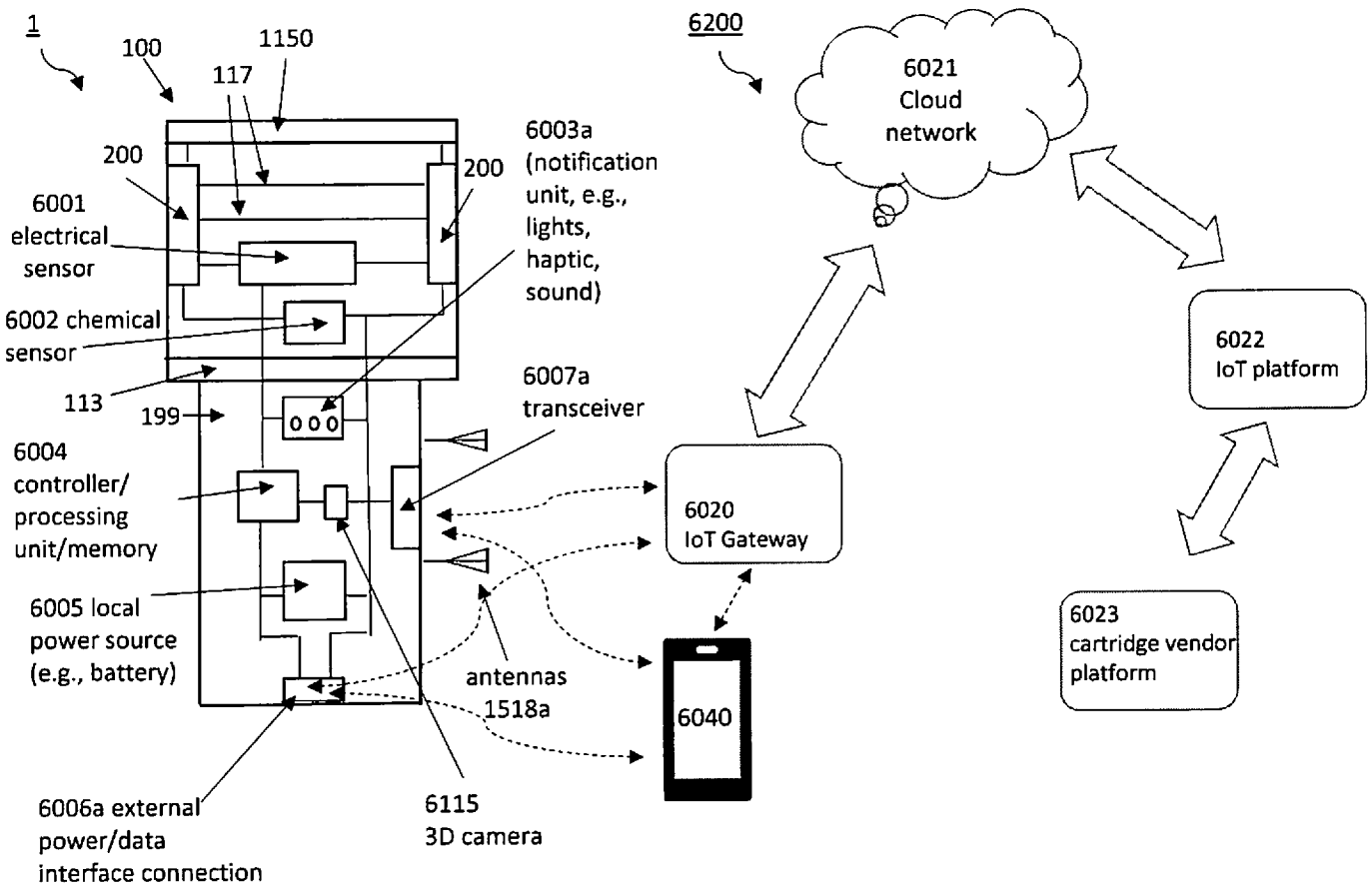
Figure 6B:
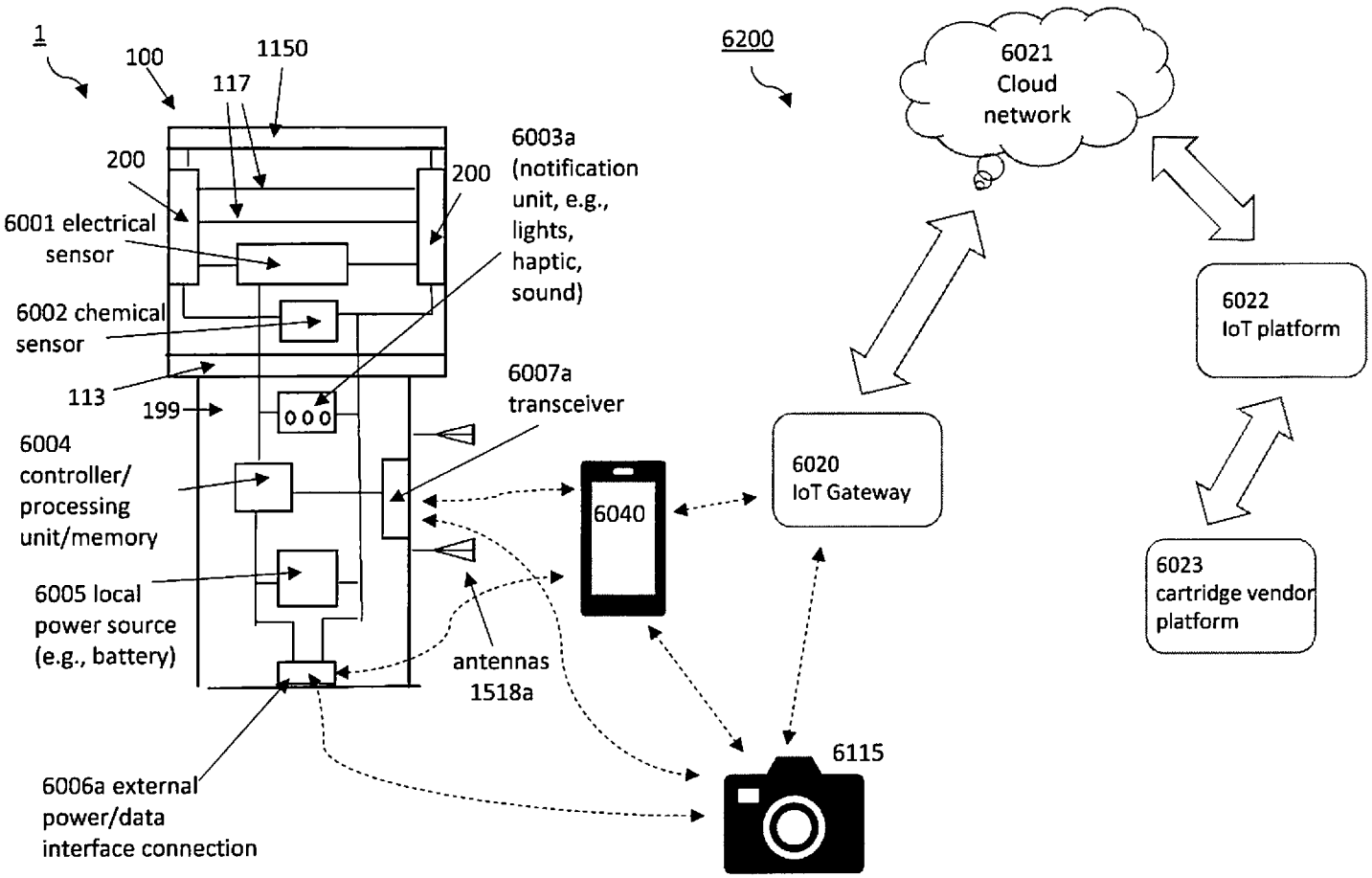

FIG. 6*a* illustrates various examples of (i) electric and/or electronic components of a razor 1 (shown on the left side of FIG. 6*a*) having a cartridge 100, a handle 199 and a smart polymer strip 1150, (ii) electronic components of an external communication infrastructure 6200 (shown on the right side of FIG. 6*a*), and (iii) various connection and communication paths between the razor 1 and the external communication infrastructure 6200, according to an embodiment of the present disclosure.

Razor 1, illustrated in FIG. 6*a*, includes the following exemplary components that are electrically and/or communicatively connected: an electrical sensor 6001; a chemical sensor 6002, which can be provided in addition to the electrical sensor 6001; a 3D camera 6115; a notification unit 6003*a*, which can be configured to generate a visual (e.g., lights), haptic and/or sound notification; a control unit 6004, which can be configured to include a controller, a processing unit and/or a memory; a local power source 6005 (e.g., battery); an interface unit 6006*a*, which can be configured as an interface for external power connection and/or external data connection; a transceiver unit 6007*a* for wireless communication; and antennas 1518*a*. Some of the communication technologies that may be used in connection with units 6006*a* and 6007*a* include cellular, satellite, WiFi, Bluetooth, low-power wide-area networks (LPWAN), or connecting directly to the internet via ethernet. Some of the data transfer protocols that can be utilized include, e.g., hypertext transfer protocol (HTTP), message queuing telemetry transport (MQTT), and constrained application protocol (CoAP), which examples are not limiting.

The electrical sensor 6001 can be configured to detect a measurement parameter relating to the level of blade wear of the blade(s) 117. The electrical sensor 6001 can use, e.g., one or more of an electrical sensing technique and/or an electrochemical sensing technique to detect a physical and/or an electrochemical property of the blade(s) 117 indicative of a level of blade wear. For example, the level of blade wear may be determined based on the level of depletion of a coating applied to one or more of the blades(s) 117, which level of depletion in turn affects the electrical property and/or the electrochemical property of the one or more blade(s) 117. This example should not be construed as limiting. In addition, or alternatively, measurement parameter output from the chemical sensor 6002 (e.g., a parameter relating to a level of material coating indicating blade wear) can be used to determine the level of blade wear of the blade(s) 117. The output information from the electrical sensor 6001 and/or the chemical sensor 6002 can be compared to a reference threshold parameter level to determine the level of blade wear.

In an example embodiment, the control unit 6004 receives and processes the information output from the electrical sensor 6001 and/or the chemical sensor 6002 to output an indication (e.g., via the notification unit 6003*a*) regarding the level of wear of the blades 117, e.g., that the blades 117 are sufficiently worn as to require a replacement of the cartridge 100. The notification unit 6003*a* can provide an indication of the level of wear of the blades 117 (including an indication to replace the cartridge containing the blades 117) by at least one of (i) a light indication (e.g., using different colored LED lights), (ii) an aural indication (e.g., using different sound levels and/or patterns), and/or (iii) a haptic indication (e.g., using different haptic intensity and/or patterns). Alternatively, a user can manually determine that the blades 117 are sufficiently worn as to require a replacement of the cartridge 100.

Control unit 6004 can also (i) receive and process the information output from the 3D camera 6115, and/or (ii) control the 3D camera 6115 to capture and/or output visual information. In an example embodiment, the 3D camera 6115 can capture images (e.g., of the user's skin surface) when the recording function of the 3D camera 6115 is activated. In this case, as shown in FIG. 6*a*, the information captured by the 3D camera 6115 can be processed by the control unit 6004 and/or presented for viewing, e.g., via a display element of the 3D camera 6115.

Control unit 6004 can cumulatively collect and/or store the information regarding the determined level of blade wear (or corresponding remaining amount/percentage) to analyze and/or determine the rate of blade wear. In addition, control unit 6004 can analyze the rate of blade wear in conjunction with (i) information captured by the 3D camera 6115 regarding a user's particular skin characteristics and/or hair properties, and/or (ii) data provided by a user or data from a database regarding particular skin characteristics and/or hair properties, thereby enabling customized analysis and data collection of an individual user's physical properties and/or razor use. The data regarding blade wear, the data regarding particular skin characteristics and/or hair properties, and/or information captured by the 3D camera 6115 can be stored (in part or in entirety) in the razor, in a cloud database, or in an external device (e.g., an IoT connected device).

The information output from the control unit 6004, electrical sensor 6001, chemical sensor 6002, the information regarding the determined level of wear (or corresponding remaining blade use), and/or information captured by the 3D camera 6115 can be transmitted from the razor 1 (i) wirelessly via the transceiver 6007*a* and/or (ii) via a wired connection through interface unit 6006*a* for external power/data connection, to an IoT gateway 6020. In addition, the transceiver 6007*a* can be connected wirelessly and/or the interface 6006*a* can be connected via a wired connection to a mobile device 6040 (e.g., a mobile phone or a tablet), which can be provided with a 3D camera and a display.

In the example embodiment shown in FIG. 6*a*, the circuitry of the razor 1 may be configured as a unit that is Internet Protocol (IP) capable by itself, and the information flow from and to the razor 1 is routed through, e.g., a WiFi router serving as the IoT gateway 6020. Alternatively, the circuitry of the razor 1 may be configured as a unit that is not Internet Protocol (IP) capable by itself, in which case the IoT gateway performs functions involved in communicating via the Internet/cloud, e.g., translating protocols, encrypting, processing, managing data, etc. Other communication technologies may include cellular, satellite, Bluetooth, low-power wide-area networks (LPWAN), or connecting directly to the internet via ethernet, which examples are not limiting. The information may be routed from the IoT gateway 6020 to a cartridge vendor platform 6023 via a cloud network 6021 and an IoT platform 6022. Although the IoT platform 6022 is shown separately from the cloud network 6021 in FIG. 6*a*, the cloud network 6021 can encompass the IoT platform 6022. As used in this disclosure, the term "cloud network" encompasses the Internet and the associated connection infrastructure.

In addition, the razor 1 can be additionally provided with hardware (e.g., a two-way microphone/speaker) and/or software (e.g., natural language processing (NLP)) elements that enable handling of natural language input and/or output. The natural-language processing can be performed at the control unit 6004, the cloud network 6021, the IoT platform 6022, and/or the cartridge vendor platform 6023.

In an example embodiment, the user data (e.g., data and/or information regarding the user's hair thickness, skin characteristics, skin contour, face contour, and/or image information captured by the 3D camera 6115 regarding a skin surface area to which the razor 1 has been applied) may be stored (in part or in entirety) at the controller 6004, the mobile device 6040, the cartridge vendor platform 6023 and/or at the IoT platform 6022. In one example, the cartridge vendor platform 6023 may (i) provide a suggestion, e.g., regarding optimum razor model and/or razor cartridge model, and/or (ii) transmit to the razor 1 and/or the mobile device 6040 information (visual, audio and/or data) regarding an individual user's razor use (e.g., whether a skin surface area imaged and/or scanned by the 3D camera has been adequately shaved), skin characteristics, hair characteristics, historically preferred razor cartridge model and/or quantity package, etc., which information may be output via the 3D camera 6115 and/or the mobile device 6040. In another example, the 3D camera 6115 of the razor 1 can be used by a user to perform a 3D scan of a body area to be shaved (e.g. face, legs, etc.) in order to (i) determine whether the skin surface of the particular body area has been adequately shaved and/or (ii) guide the user while shaving (by having performed and stored a 3D scan prior to shaving).

FIG. 6*b* illustrates various connection and communication paths between the razor 1 and the external communication infrastructure 6200, according to another embodiment of the present disclosure. In the embodiment shown in FIG. 6*b*, the 3D camera 6115 (which can include a display element) is provided separately from the razor 1 and can be used completely independently of the razor 1. Alternatively, as shown in FIG. 6*b*, the 3D camera 6115 and/or a mobile device 6040 with a 3D camera can be (i) communicatively connected wirelessly to the transceiver 6007*a*, and/or (ii) communicatively connected via a hardwire connection to the interface unit 6006*a*. Regardless of whether the communication connection is wireless or hardwire, the 3D camera 6115 and/or a mobile device 6040 with a 3D camera can be also mechanically coupled to the razor 1, thereby enabling monitoring and feedback regarding the shaving surface while the razor 1 is being used. In the example embodiment shown in FIG. 6*b*, the mobile device 6040 and/or the 3D camera 6115 can be configured as Internet Protocol (IP) capable devices, and the circuitry of razor 1 need not be Internet Protocol (IP) capable by itself, although the example embodiment does not preclude the circuitry of razor 1 being IP-capable by itself.

In one communication path of the example embodiment illustrated in FIG. 6*b*, information output from the control unit 6004, electrical sensor 6001, chemical sensor 6002, 3D camera 6115, the information regarding the determined level of wear (or corresponding remaining blade use), and/or information regarding a user's physical characteristics (e.g., data and/or information regarding the user's hair thickness, skin characteristics, skin contour, face contour, and/or image information captured by the 3D camera 6115 regarding the user's skin surface area) can be transmitted from the razor 1 (e.g., while the user is using the razor 1 in a bathroom) and/or the 3D camera 6115 to a mobile device 6040. In one example, the 3D camera 6115 communicatively connected to the razor 1 can be used by a user to perform a 3D scan of a body area to be shaved (e.g. face, legs, etc.) in order to (i) determine whether the skin surface of the particular body area has been adequately shaved and/or (ii) guide the user while shaving (by having performed and stored a 3D scan prior to shaving).

The mobile device 6040 can be provided with client(s) (e.g., one or more application software or "app") and perform some or all of the functionalities performed by the circuitry components of the razor 1 shown in FIG. 6*a*, e.g., transmitting information via the Internet, data analysis, and/or storage of acquired information. The information received by the mobile device 6040 may be routed to the IoT gateway 6020, e.g., a WiFi router, and subsequently routed to a cartridge vendor platform 6023 via the cloud network 6021 and the IoT platform 6022. Based on the information routed from the mobile device 6040, the cartridge vendor platform 6023 and/or the IoT platform 6022 can provide appropriate feedback information, e.g., optimum razor model for the user, optimum razor cartridge model for the user, and/or information (visual, audio and/or data) regarding whether the user's skin surface area imaged by the 3D camera 6115 has been adequately shaved. Although the IoT platform 6022 is shown separately from the cloud network 6021 in FIG. 6*a*, the cloud network 6021 may encompass the IoT platform 6022. Other communication technologies may include cellular, satellite, Bluetooth, low-power wide-area networks (LPWAN), or connecting directly to the internet via ethernet, which examples are not limiting. Some of the data transfer protocols that may be utilized include, e.g., hypertext transfer protocol (HTTP), message queuing telemetry transport (MQTT), and constrained application protocol (CoAP), which examples are not limiting.

In another communication path of the example embodiment illustrated in FIG. 6*b*, information output from the control unit 6004, electrical sensor 6001, chemical sensor 6002, the information regarding the determined level of wear (or corresponding remaining blade use), and/or information regarding a user's physical characteristics (e.g., data and/or information regarding the user's hair thickness, skin characteristics, skin contour, face contour) can be transmitted from the razor 1 (e.g., while the user is using the razor 1 in a bathroom) to the 3D camera 6115, which can be provided with client(s) (e.g., one or more application software) and perform some or all of the functionalities performed by the circuitry components of the razor 1 shown in FIG. 6*a*, e.g., transmitting information via the Internet, data analysis, and/or storage of acquired information. The information received by the 3D camera 6115, along with the image information captured by the 3D camera 6115 regarding the user's skin surface area, may be routed to the IoT gateway 6020, e.g., a WiFi router, and subsequently routed to a cartridge vendor platform 6023 via the cloud network 6021 and the IoT platform 6022. Based on the information routed from the 3D camera 6115, the cartridge vendor platform 6023 and/or the IoT platform 6022 can provide appropriate feedback information, e.g., optimum razor model for the user, optimum razor cartridge model for the user, and/or information (visual, audio and/or data) regarding whether the user's skin surface area imaged by the 3D camera 6115 has been adequately shaved. Other communication technologies may include cellular, satellite, Bluetooth, low-power wide-area networks (LPWAN), or connecting directly to the internet via ethernet, which examples are not limiting.

In the example system illustrated in FIG. 6*b*, information and/or processing of information can be shared among two or more of the razor 1, the 3D camera 6115, the mobile device 6040, the IoT gateway 6020, the cloud network 6021, the IoT platform 6022 and/or the cartridge vendor platform 6023. For example, the processing of information (regardless of the source of information) can be performed at the control unit 6004, the 3D camera 6115, the mobile device 6040, the cloud network 6021, the IoT platform 6022, and/or the cartridge vendor platform 6023. In addition, input/output of information (e.g., audio, visual, and/or data) can be implemented via the 3D camera 6115, the 2-way microphone/speaker may be provided on or in the razor 1, and/or the mobile device 6040.

As an example of distributed functionality in the example system illustrated in FIG. 6*b*, the image information (e.g., of the user's skin surface) captured by the 3D camera 6115 can be transmitted to the mobile device 6040 (e.g., for display) and/or to the cartridge vendor platform 6023 (e.g., for analysis). In addition, the sensor data from the electrical sensor 6001 can be transmitted to the 3D camera 6115 and/or the mobile device 6040 (e.g., while the user is using the cartridge on which the electrical sensor 6001 is provided), and the user's voice command and/or query can be inputted via the 2-way microphone/speaker may be provided on or in the razor 1 or the microphone/speaker of the mobile device 6040. In addition, the information contained in the response transmission from the cartridge vendor platform 6023 can be outputted via the microphone/speaker of the razor 1 (e.g., for audio), via the mobile device 6040 (e.g., for audio, visual and/or text data), and/or via the display screen of the 3D camera 6115 (e.g., for visual and/or text data).

FIG. 7 illustrates a logic flow 700 of an example method of using a 3D camera to assist a user, e.g., in connection with shaving and/or shaving razor selection/replacement. At block 7001, image of at least one of a user's skin surface and the user's body contour is recorded and/or scanned by a 3D camera (e.g., 3D camera 6115 or a 3D camera of the mobile device 6040). At block 7002, a control unit communicatively connected to the 3D camera (e.g., the control unit 6004, a control unit of the 3D camera 6115, a control unit of the mobile device 6040, a control unit of the cartridge vendor platform 6023, and/or a control unit of the IoT platform 6022) processes image data of the image recorded by the 3D camera to determine at least one physical characteristic of the at least one of the user's skin surface and the user's body contour (e.g., of the chin area, neck area, leg area, etc.). At block 7003, a feedback information is provided (e.g., with the aid of a feedback element such as the cartridge vendor platform 6023 and/or the control unit of the cartridge vendor platform 6023) based on the at least one physical characteristic, the feedback information regarding at least one of (i) a shaving cartridge suited for the at least one physical characteristic, (ii) a shaving razor suited for the at least one physical characteristic, and (iii) amount of hair remaining on the at least one of the user's skin surface and the user's body contour recorded by the 3D camera. The feedback information can be transmitted from the feedback element via the Internet and the Internet gateway 6020 to the 3D camera (e.g., 3D camera 6115 or a 3D camera of the mobile device 6040). At block 7004, an output unit (e.g., a display of the 3D camera 6115, a display of the 3D camera of the mobile device 6040, a microphone/speaker of the mobile device 6040, and/or a microphone/speaker of the razor 1) outputs the feedback information to the user. The logic flow 700 shown in FIG. 7 and described above assumes that information and/or processing of information can be shared among two or more of the razor 1, the 3D camera 6115, the mobile device 6040, the IoT gateway 6020, the cloud network 6021, the IoT platform 6022 and/or the cartridge vendor platform 6023.

FIG. 8 illustrates a logic flow 800 of another example method of using a 3D camera to assist a user, e.g., in connection with shaving and/or shaving razor selection/replacement. At block 8001, image of at least one of a user's skin surface and the user's body contour is recorded and/or scanned by a 3D camera 6115 of the razor 1. At block 8002, image data of the image recorded by the 3D camera is transmitted, via an Internet gateway connected to the Internet, to a vendor platform (e.g., cartridge vendor platform 6023) connected to the Internet. At block 8003, a control unit communicatively connected to the vendor platform (e.g., the control unit 6004, a control unit of the cartridge vendor platform 6023, and/or a control unit of the IoT platform 6022) processes image data of the image recorded by the 3D camera 6115 to determine at least one physical characteristic of the at least one of the user's skin surface and the user's body contour. At block 8004, a feedback information is provided (e.g., with the aid of a feedback element such as the cartridge vendor platform 6023 and/or the control unit of the cartridge vendor platform 6023) based on the at least one physical characteristic, the feedback information regarding at least one of (i) a shaving cartridge suited for the at least one physical characteristic, (ii) a shaving razor suited for the at least one physical characteristic, and (iii) amount of hair remaining on the at least one of the user's skin surface and the user's body contour recorded by the 3D camera 6115. At block 8005, the feedback information is transmitted, via the Internet gateway connected to the Internet, to the 3D camera 6115 and/or the razor 1. At block 8006, an output unit of the 3D camera 6115 (e.g., a display of the 3D camera 6115) and/or the razor 1 (e.g., a microphone/speaker of the razor 1) outputs the feedback information to the user. The logic flow 800 shown in FIG. 8 and described above assumes that information and/or processing of information can be shared among two or more of the razor 1 having the 3D camera 6115, the IoT gateway 6020, the cloud network 6021, the IoT platform 6022 and/or the cartridge vendor platform 6023.

FIG. 9 illustrates a logic flow 900 of yet another example method of using a 3D camera to assist a user, e.g., in connection with shaving and/or shaving razor selection/replacement. At block 9001, image of at least one of a user's skin surface and the user's body contour is recorded and/or scanned by a 3D camera (e.g., 3D camera 6115 or a 3D camera of the mobile device 6040) mechanically and/or communicatively connected or coupled to a razor (e.g., razor 1). At block 9002, image data of the image recorded by the 3D camera is transmitted, via an Internet gateway connected to the Internet, to a vendor platform (e.g., cartridge vendor platform 6023) connected to the Internet. At block 9003, a control unit communicatively connected to the vendor platform (the control unit 6004, a control unit of the 3D camera 6115, a control unit of the mobile device 6040, a control unit of the cartridge vendor platform 6023, and/or a control unit of the IoT platform 6022) processes image data of the image recorded by the 3D camera 6115 to determine at least one physical characteristic of the at least one of the user's skin surface and the user's body contour. At block 9004, a feedback information is provided (e.g., with the aid of a feedback element such as the cartridge vendor platform 6023 and/or the control unit of the cartridge vendor platform 6023) based on the at least one physical characteristic, the feedback information regarding at least one of (i) a shaving cartridge suited for the at least one physical characteristic, (ii) a shaving razor suited for the at least one physical characteristic, and (iii) amount of hair remaining on the at least one of the user's skin surface and the user's body contour recorded by the 3D camera 6115. At block 9005, the feedback information is transmitted, via the Internet gateway connected to the Internet, to the 3D camera (e.g., 3D camera 6115 or the 3D camera of the mobile device 6040) and/or the razor 1. At block 9006, an output unit of the 3D camera (e.g., a display of the 3D camera 6115, a display of the 3D camera of the mobile device 6040 and/or a microphone/speaker of the mobile device 6040 having the 3D camera) and/or the razor (e.g., a microphone/speaker of the razor 1) outputs the feedback information to the user. The logic flow 900 shown in FIG. 9 and described above assumes that information and/or processing of information can be shared among two or more of the razor 1, the 3D camera 6115, the mobile device 6040, the IoT gateway 6020, the cloud network 6021, the IoT platform 6022 and/or the cartridge vendor platform 6023.

It should be noted that parts of the example techniques 700, 800 and 900 illustrated in FIGS. 7-9 can be modified and/or combined in part and/or entirely.

FIG. 10 illustrates an embodiment of a storage medium 1100, which can comprise an article of manufacture, e.g., storage medium 1100 can include any non-transitory computer readable medium or machine-readable medium, such as an optical, magnetic or semiconductor storage. Storage medium 1100 can store various types of computer executable instructions, e.g., 1120. For example, storage medium 2000 can store various types of computer executable instructions to implement techniques 700, 800, and 900. Further, such instructions can be executed by, e.g., control unit 6004, computer 6030 and/or mobile device 6040, to carry out the techniques described herein.

Some examples of a computer readable storage medium or machine-readable storage medium can include tangible media capable of storing electronic data, e.g., volatile memory or non-volatile memory, removable or non-removable memory, erasable or non-erasable memory, writeable or re-writeable memory, and the like. Some examples of computer-executable instructions can include suitable type of code, e.g., source code, compiled code, interpreted code, executable code, static code, dynamic code, object-oriented code, visual code, and the like. The examples are not limited in this context.

FIG. 11 illustrates an embodiment of a communications device 1500 which can implement one or more of logic flow 700, logic flow 800, and logic flow 900, storage medium 1100, the computer 6030, the mobile device 6040, and one or more functionalities of the circuitry of razor 1, according to one or more embodiments. In an example embodiment, communication device 1500 can comprise a logic circuit 1528 which can include physical circuits to perform operations described for one or more of logic flow 700, logic flow 800, and logic flow 900, for example. In addition, communication device 1500 can include a radio interface 1510, baseband circuitry 1520, and computing platform 1530. However, the embodiments are not limited to this example configuration.

Communication device 1500 can implement some or all of the structure and/or operations for one or more of logic flow 700, logic flow 800, and logic flow 900, storage medium 1100, computer 6030, mobile device 6040, one or more functionalities of the circuitry of razor 1, and logic circuit 1528 in (i) a single computing entity, e.g., a single device, or (ii) in a distributed manner. In the latter case, communication device 1500 can distribute portions of the structure and/or operations for one or more of logic flow 700, logic flow 800, and logic flow 900, storage medium 1100, computer 6030, mobile device 6040, one or more functionalities of the circuitry of razor 1, and logic circuit 1528 across multiple computing platforms and/or entities using a distributed system architecture, e.g., a master-slave architecture, a client-server architecture, a peer-to-peer architecture, a shared database architecture, and the like. The embodiments are not limited in this context.

In an example embodiment, radio interface 1510 can include one or more component(s) adapted to transmit and/or receive single-carrier or multi-carrier modulated signals such as CCK (complementary code keying), OFDM (orthogonal frequency division multiplexing), and/or SC-FDMA (single-carrier frequency division multiple access) symbols. Radio interface 1510 can include, e.g., a receiver 1511, a frequency synthesizer 1514, a transmitter 1516, and one or more antennas 1518. However, the embodiments are not limited to these examples.

Baseband circuitry 1520, which communicates with radio interface 1510 to process receive signals and/or transmit signals, can include a unit 1522 comprising an analog-to-digital converter, a digital-to-analog converter, and a baseband or physical layer (PHY) processing circuit for physical link layer processing of receive/transmit signals. Baseband circuitry 1520 can also include, for example, a memory controller 1532 for communicating with a computing platform 1530 via an interface 1534.

Computing platform 1530, which can provide computing functionality for device 1500, can include a processor 1540 and other platform components 1750, e.g., processors, memory units, chipsets, controllers, peripherals, interfaces, input/output (I/O) components, power supplies, and the like.

Device 1500 can be, e.g., a mobile device, a smart phone, a fixed device, a machine-to-machine device, a personal digital assistant (PDA), a mobile computing device, a user equipment, a computer, a network appliance, a web appliance, consumer electronics, programmable consumer electronics, game devices, television, digital television, set top box, wireless access point, base station, subscriber station, mobile subscriber center, radio network controller, router, hub, gateway, and the like. These examples are not limiting.

FIG. 12 is an exemplary system embodiment configured as a platform 1200, which can include, e.g., a processor 902, a chipset 904, an I/O (input/output) device 906, a RAM (random access memory) 908, e.g., DRAM (dynamic RAM), and a ROM (read only memory) 910, a wireless communications chip 916, a graphics device 918, and a display 920, and other platform components 914 (e.g., a cooling system, a heat sink, vents, and the like), which are coupled to one another by way of a bus 312 and chipset 904. The examples are not limiting.

The techniques described herein are exemplary, and should not be construed as implying any specific limitation on the present disclosure. It should be understood that various alternatives, combinations and modifications could be devised by those skilled in the art. For example, steps associated with the processes described herein can be performed in any order, unless otherwise specified or dictated by the steps themselves. The present disclosure is intended to embrace all such alternatives, modifications and variances that fall within the scope of the appended claims.

The terms "comprise" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles. The terms "coupled," "connected" and "linked" are used interchangeably in this disclosure and have substantially the same meaning.

Some embodiments may be described using the expression "one embodiment" or "an embodiment" along with their derivatives. These terms mean that a particular feature, structure, or characteristic described in connection with the embodiment is included in at least one embodiment. The appearances of the phrase "an embodiment" in various places in the specification are not necessarily all referring to the same embodiment.

As is evident from the figures and text presented above, as well as the examples below, a variety of embodiments are contemplated:

Embodiments

1. A system configured to assist a user with a shaving activity, comprising:
   - a 3D camera (6115) configured to record an image of at least one of the user's skin surface and the user's body contour;
   - a control unit (6004) communicatively connected to the 3D camera and configured to process image data of the image recorded by the 3D camera to determine at least one physical characteristic of the at least one of the user's skin surface and the user's body contour;
   - a feedback element (6023) configured to aid in providing a feedback information based on the at least one physical characteristic, wherein the feedback information is regarding at least one of (i) a shaving cartridge (100) suited for the at least one physical characteristic, (ii) a shaving razor suited for the at least one physical characteristic, and (iii) amount of hair remaining on the at least one of the user's skin surface and the user's body contour recorded by the 3D camera; and
   - an output unit configured to output the feedback information.

2. The system according to embodiment 1, wherein the 3D camera (6115) is an Internet Protocol (IP) capable device, and wherein the 3D camera is configured to directly interface with an Internet gateway connected to the Internet to transmit the image data of the image recorded by the 3D camera.

3. The system according to embodiment 1 or 2, further comprising:
   - a razor (1);
   - wherein the 3D camera (6115) is at least one of communicatively and mechanically connected to the razor.

4. The system according to embodiment 3, wherein the 3D camera (6115) is provided in the razor.

5. The system according to any one of embodiments 1 to 4, wherein the control unit (6004) is communicatively connected to a vendor platform (6023) serving as the feedback element, and wherein the image data of the image recorded by the 3D camera is transmitted to the control unit via an Internet gateway connected to the Internet.

6. The system according to embodiment 5, wherein the feedback information is transmitted from the vendor platform (6023) to the 3D camera via the Internet gateway connected to the Internet.

7. The system according to embodiments 3 and 5, taken in combination with any one of embodiments 1 to 6, wherein the feedback information is transmitted from the vendor platform (6023) to the razor (1) via the Internet gateway connected to the Internet.

8. The system according to embodiment 3, taken in combination with any one of embodiments 1 to 7, wherein the 3D camera (6115) is mechanically connected to the razor (1), and wherein the output unit is a display screen of the 3D camera.

9. The system according to any one of embodiments 1 to 3 or 5 to 8, wherein the 3D camera (6115) is provided as a part of a mobile device (6040), and wherein the output unit is a display screen of the mobile device.

10. A method for assisting a user with a shaving activity, comprising:

recording, by a 3D camera (6115), an image of at least one of the user's skin surface and the user's body contour;

processing, by a control unit (6004) communicatively connected to the 3D camera, image data of the image recorded by the 3D camera to determine at least one physical characteristic of the at least one of the user's skin surface and the user's body contour;

providing, with the aid of a feedback element (6023), a feedback information based on the at least one physical characteristic, wherein the feedback information is regarding at least one of (i) a shaving cartridge (100) suited for the at least one physical characteristic, (ii) a shaving razor suited for the at least one physical characteristic, and (iii) amount of hair remaining on the at least one of the user's skin surface and the user's body contour recorded by the 3D camera; and outputting, by an output unit, the feedback information.

11. The method according to embodiment 10, wherein the 3D camera (6115) is an Internet Protocol (IP) capable device, and wherein the 3D camera directly interfaces with an Internet gateway connected to the Internet to transmit the image data of the image recorded by the 3D camera.

12. The method according to embodiment 10 or 11, wherein the 3D camera (6115) is at least one of communicatively and mechanically connected to a razor (1).

13. The method according to embodiment 12, wherein the 3D camera (6115) is provided in the razor.

14. The method according to any one of embodiments 10 to 13, wherein the control unit (6004) is communicatively connected to a vendor platform (6023) serving as the feedback element, and wherein the image data of the image recorded by the 3D camera is transmitted to the control unit via an Internet gateway connected to the Internet.

15. The method according to embodiment 14, wherein the feedback information is transmitted from the vendor platform (6023) to the 3D camera (6115) via the Internet gateway connected to the Internet.

15. The method according to embodiments 12 and 14, taken in combination with any one of embodiments 10 to 14, wherein the feedback information is transmitted from the vendor platform (6023) to the razor (1) via the Internet gateway connected to the Internet.

16. The method according to embodiment 12, wherein the 3D camera (6115) is mechanically connected to the razor (1), and wherein the output unit is a display screen of the 3D camera.

17. The method according to any one of embodiments 10 to 12 or 14 to 16, wherein the 3D camera (6115) is provided as a part of a mobile device, and wherein the output unit is a display screen of the mobile device.

18. The method according to any one of embodiments 10 to 17, wherein:

the 3D camera performs a 3D scan of a selected body area; and the 3D scan data is used to at least one of (i) determine whether a skin surface of the selected body area has been adequately shaved, and (ii) guide a user of the razor in shaving.

What is claimed is:

1. A system configured to assist a user with a suggestion of a shaving cartridge model or a shaving razor model, comprising:

a first razor for shaving hair;

a three dimension (3D) camera configured to record an image of at least one of a user's skin surface or a user's body contour;

a control unit communicatively connected to the 3D camera and configured to process image data of the image recorded by the 3D camera to determine at least one physical characteristic of the at least one of the user's skin surface or the user's body contour;

wherein the control unit is configured to provide feedback information received from a vendor platform based on the at least one physical characteristic, wherein the feedback information is regarding a suggestion of at least one of (i) the shaving cartridge model suited for the at least one physical characteristic and/or (ii) the shaving razor model suited for the at least one physical characteristic; and an output unit configured to receive the feedback information from the control unit and output the feedback information.

2. The system according to claim 1, wherein the 3D camera is configured to directly interface with an Internet gateway connected to the Internet to transmit the image data of the image recorded by the 3D camera.

3. The system according to claim 1;

wherein the 3D camera is at least one of communicatively or mechanically connected to the first razor.

4. The system according to claim 1, wherein:

the control unit is communicatively connected to the vendor platform, the image data of the image recorded by the 3D camera is transmitted to the control unit via an Internet gateway connected to the Internet, and the feedback information is transmitted from the vendor platform to at least one of the first razor or the 3D camera via the Internet gateway connected to the Internet.

5. The system according to claim 1, wherein:

the control unit is communicatively connected to the vendor platform, the image data of the image recorded by the 3D camera is transmitted to the control unit via an Internet gateway connected to the Internet, and the feedback information is transmitted from the vendor platform to the 3D camera via the Internet gateway connected to the Internet.

6. The system according to claim 5, wherein the vendor platform includes the control unit.

7. The system according to claim 1, wherein the 3D camera is provided as a part of a mobile device.

8. The system of claim 1, wherein the first razor or the 3D camera includes the control unit.

9. The system of claim 1, further comprising a mobile device, wherein the mobile device includes the control unit.

10. The system of claim 1, wherein the first razor includes:

the 3D camera, and at least one of:

an electrical sensor configured to detect an electrochemical property of a blade of the first razor, or a chemical sensor configured to detect a level of coating included in the first razor, wherein the control unit is configured to determine a level of wear on the blade based on a detection by the electrical sensor and/or the chemical sensor.

11. A method for providing a shaving recommendation using the system of claim 1, the method comprising:

receiving information about at least one of the user's skin surface or the user's body contour, the information including at least one of:

the image recorded by the three dimension (3D) camera of at least one of the user's skin surface of the user's body contour during shaving using the first razor, or the determined at least one physical characteristic;

determining, based on the received information, the feedback information, the feedback information including the suggestion of the at least one of (i) the cartridge model suited for the user or (ii) the razor model suited for the user; and transmitting the determined feedback information to the first razor, the 3D camera, and/or a mobile device.

12. The method of claim 11, wherein the method further comprises transmitting, from the vendor platform to the first razor, the 3D camera, the mobile device, and/or the control unit, at least one of:

whether the skin surface has been adequately shaved, skin characteristics, hair characteristics, and/or a historically preferred razor cartridge model and/or a quantity package.

13. A method for assisting a user with a suggestion of a shaving cartridge model or a shaving razor model based on shaving with an initial razor, comprising:

recording, by a 3D (three-dimension) camera, an image of at least one of the user's skin surface or the user's body contour;

processing image data of the image recorded by the 3D camera to determine at least one physical characteristic of the at least one of the user's skin surface or the user's body contour;

receiving, by a control unit, feedback information from a vendor platform;

providing feedback information based on the at least one physical characteristic, wherein the feedback information is regarding a suggestion of at least one of (i) the shaving cartridge model suited for the at least one physical characteristic, or (ii) the shaving razor model suited for the at least one physical characteristic; and outputting, by an output unit configured to receive the feedback information from the control unit, the feedback information.

14. The method according to claim 13, wherein the 3D camera is at least one of communicatively or mechanically connected to the initial razor, wherein the 3D camera and/or the initial razor is communicatively connected to the vendor platform and receives the feedback information from the vendor platform.

15. The method according to claim 13, further comprising a mobile device communicatively connected to the vendor platform, wherein the mobile device receives the feedback information from the vendor platform.

16. The method according to claim 13, wherein the image data of the image recorded by the 3D camera is transmitted to the vendor platform.

17. The method according to claim 13, wherein:

the 3D camera is at least one of mechanically connected to or communicatively connected to the initial razor;

the 3D camera performs a 3D scan of a selected body area; and the 3D scan data is used to at least one of (i) determine whether the skin surface of the selected body area has been adequately shaved, or (ii) guide a user of the initial razor in shaving.

* * * * *